US007404699B2

(12) United States Patent
Thamm et al.

(10) Patent No.: US 7,404,699 B2
(45) Date of Patent: Jul. 29, 2008

(54) TURBOMACHINE

(75) Inventors: Norbert Thamm, Essen (DE); Andreas Ulma, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 180 days.

(21) Appl. No.: 10/587,628

(22) PCT Filed: Jan. 25, 2005

(86) PCT No.: PCT/EP2005/000710

§ 371 (c)(1),
(2), (4) Date: Jul. 28, 2006

(87) PCT Pub. No.: WO2005/073517

PCT Pub. Date: Aug. 11, 2005

(65) Prior Publication Data

US 2007/0166152 A1 Jul. 19, 2007

(30) Foreign Application Priority Data

Jan. 30, 2004 (EP) ..... 04002157

(51) Int. Cl.
*F01D 25/00* (2006.01)

(52) U.S. Cl. ..... 415/200; 415/216.1

(58) Field of Classification Search ..... None
See application file for complete search history.

(56) References Cited

U.S. PATENT DOCUMENTS

| | | | | |
|---|---|---|---|---|
| 5,749,228 | A * | 5/1998 | Shiga et al. | 415/216.1 |
| 6,224,334 | B1 * | 5/2001 | Siga et al. | 415/200 |
| 2001/0021346 | A1 * | 9/2001 | Doi et al. | 416/241 R |

FOREIGN PATENT DOCUMENTS

| | | | |
|---|---|---|---|
| EP | 0 759 499 | A1 | 2/1997 |
| EP | 0759499 | A * | 2/1997 |
| EP | 0 767 250 | A2 | 4/1997 |
| EP | 0767250 | A * | 4/1997 |
| EP | 0 831 203 | A2 | 3/1998 |

* cited by examiner

*Primary Examiner*—Richard Edgar

(57) ABSTRACT

The invention relates to a turbine machine, in particular, a steam turbine, comprising an inner housing, a turbine shaft, mounted such as to rotate, characterized in that the inner housing and the turbine shaft are produced from differing materials. The turbine is made from a chrome steel with 9 to 12 wt. % of chromium and the inner housing from a chrome steel with 1 to 2 wt % of chromium.

9 Claims, 1 Drawing Sheet

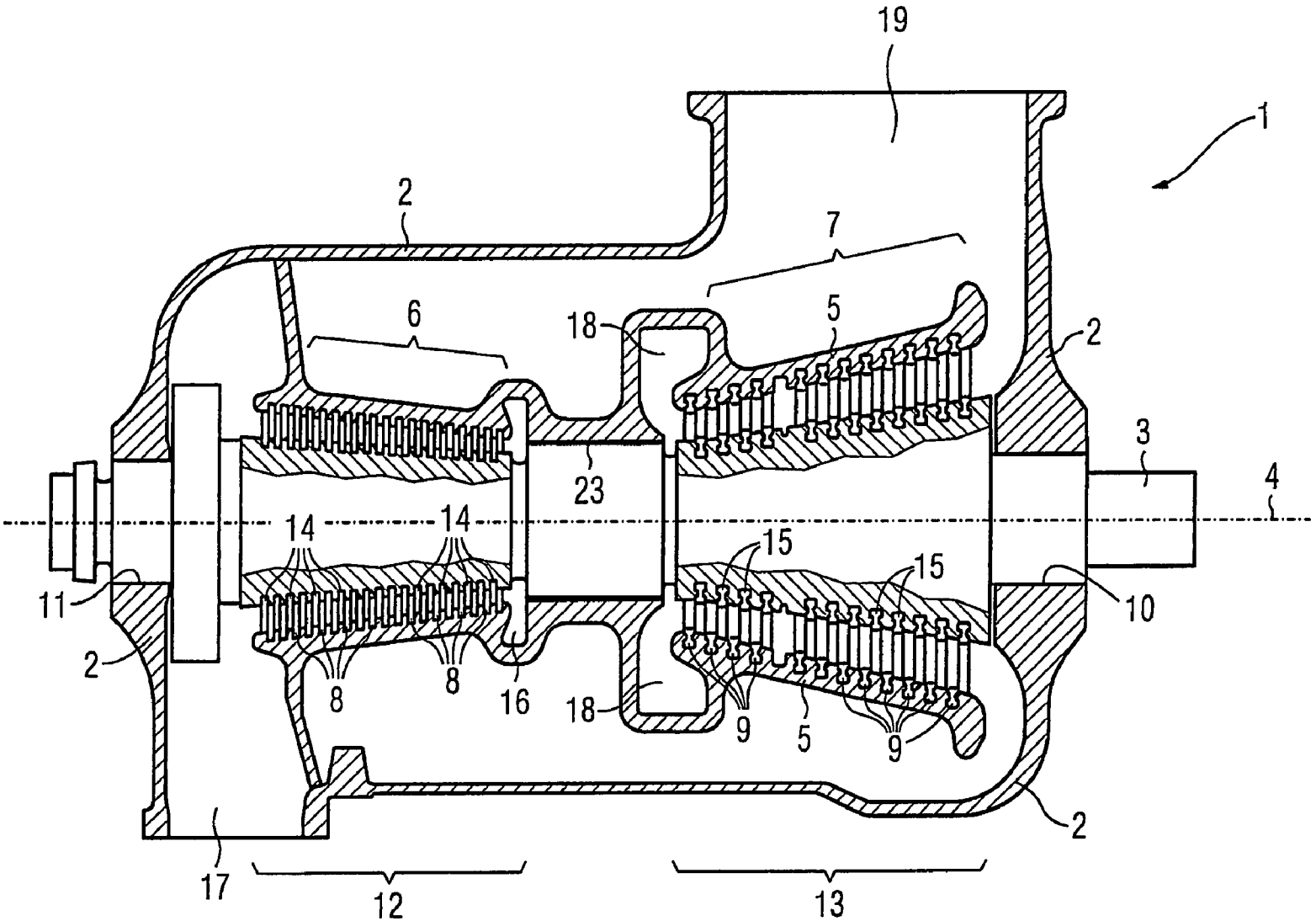
1
4
3
10
2
2
19
7
5
15
9
13
5
15
9
18
23
18
16
14
8
2
6
12
8
14
17
2
11

TURBOMACHINE

CROSS REFERENCE TO RELATED APPLICATIONS

This application is the US National Stage of International Application No. PCT/EP2005/000710, filed Jan. 25, 2005 and claims the benefit thereof. The International Application claims the benefits of European Patent application No. 04002157.8 filed Jan. 30, 2004. All of the applications are incorporated by reference herein in their entirety.

FIELD OF THE INVENTION

The invention relates to a turbomachine having an inner casing and a rotatably mounted turbine shaft.

BACKGROUND OF THE INVENTION

A steam turbine as an embodiment of a turbomachine within the meaning of the present invention is to be understood as meaning any turbine or partial turbine through which a working medium in the form of steam flows. By contrast, gas and/or air flows through gas turbines as working medium, but this involves completely different temperature and pressure conditions than the steam in a steam turbine. Unlike gas turbines, in steam turbines by way of example the working medium at the highest temperature flowing to a partial turbine is at the same time also at the highest pressure. A steam turbine usually comprises a turbine shaft which is fitted with blades, is mounted rotatably and is arranged within an inner casing. As heated and pressurized steam flows through the interior of the flow space formed by the inner casing, the turbine shaft is made to rotate by the steam via the blades.

The blades of the turbine shaft are also known as rotor blades. Furthermore, it is customary for guide vanes to be mounted on the inner casing, engaging into the spaces between the rotor blades. The inner casing can also be referred to as the casing shell. A guide vane is usually held at a first position along an inner side of the steam turbine casing. It is usually part of a guide vane ring comprising a number of guide vanes which are arranged along an inner circumference of the inner casing. In this case, the air foil part of each guide vane faces radially inward.

Steam turbines or steam partial turbines can be divided into high-pressure partial turbines, intermediate-pressure partial turbines or low-pressure partial turbines. The entry temperatures and entry pressures of high-pressure partial turbines may be 600° C. and 300 bar.

There are known single-casing steam turbines which represent a combination of a high-pressure steam turbine and an intermediate-pressure steam turbine. These steam turbines are characterized by a common casing and a common turbine shaft and are also known as compact partial turbines.

Steam turbines for higher steam states usually use a material with a high chromium content. The material with a high chromium content is usually a chromium steel with a chromium content of 9 to 12% by weight. Hitherto, the same material used for the turbine shaft has also been used as material for the inner casing. This has been justified by the coefficient of thermal expansion needing to be identical for shaft and casing. The use of the material with a high chromium content for the turbine shaft and the inner casing leads to expensive designs of steam turbine.

SUMMARY OF THE INVENTION

It is an object of the present invention to provide a turbomachine, in particular a steam turbine, having an inner casing and a rotatably mounted turbine shaft, which can be made simpler in terms of manufacturing technology.

The object is achieved by a turbomachine having an inner casing and a rotatably mounted turbine shaft, wherein the inner casing and the turbine shaft are made from different materials, the inner casing being made from a material with a lower hot strength than the material from which the turbine shaft is produced, the turbine shaft being produced from a chromium steel containing 9 to 12% by weight chromium, and the inner casing being produced from a chromium steel containing 1 to 2% by weight chromium.

The invention is based on the discovery that it is not necessary to use identical materials with a high chromium content for both the turbine shaft and the inner casing. Surprisingly, it has been discovered that the thermal expansion for high steam states, given the masses used for the turbine shaft and the inner casing, are lower than a predetermined tolerance threshold.

Hitherto, when manufacturing turbomachines, in particular steam turbines, the same types of materials have been used for the turbine shaft and for the inner casing. To allow rapid production of a steam turbine, the materials for the inner casing and for the turbine shaft have to be available close together in terms of time. The proposal of the invention to use different materials for the inner casing and the turbine shaft makes it possible to design a steam turbine to be manufactured in a simpler way.

On account of the use of a material for the inner casing which has a lower hot strength than the material for the turbine shaft, it is possible to make a turbomachine less expensive, since the material with a high hot strength is usually more expensive than material with a lower hot strength.

Furthermore, it is also possible for the inner casing to be made from a material which has a lower hot strength than the material used for the turbine shaft. Moreover, the material used for the inner casing may have a higher mechanical strength.

The term hot strength is to be understood as meaning the permissible stresses at high temperatures.

A chromium steel containing 9 to 12% by weight chromium has a high hot strength, which is required in particular when used for turbine shafts at high steam states. A chromium steel containing 1 to 2% by weight chromium does have a lower hot strength than chromium steel containing 9 to 12% by weight chromium, but on the other hand has a higher mechanical strength. Therefore, a chromium steel containing 1 to 2% by weight chromium is eminently suitable for environments with lower thermal stresses. In particular, this chromium steel is suitable for inner casings in steam turbines with high steam states.

It is preferable for the inner casing and the turbine shaft at least in part to have regions which are designed for use at temperatures of over 550° C.

The use of different materials for the inner casing and for the turbine shaft is particularly appropriate in steam turbines, high-pressure partial turbines, intermediate-pressure partial turbines, combined high-pressure and intermediate-pressure partial turbines or combined intermediate-pressure and low-pressure partial turbines. The different materials can also be used in pumps, compressors or gas turbines.

BRIEF DESCRIPTION OF THE DRAWINGS

Exemplary embodiments of the invention are described in more detail below with reference to the drawing, in which components denoted by the same reference designations in each case have the same function.

In detail, the only FIGURE of the drawing shows:

a sectional illustration through a compact partial turbine

DETAILED DESCRIPTION OF THE INVENTION

The FIGURE illustrates a sectional illustration of a compact steam turbine 1. The compact steam turbine 1 has an outer casing 2, in which a turbine shaft 3 is mounted such that it can rotate about an axis of rotation 4. The compact steam turbine 1 has an inner casing 5 with a high-pressure part 6 and an intermediate-pressure part 7. Various guide vanes 8 are arranged in the high-pressure part 6.

A number of guide vanes 9 are also arranged in the intermediate-pressure part 7. The turbine shaft 3 is mounted rotatably by means of bearings 10, 11. The inner casing 5 is connected to the outer casing 2.

The steam turbine 1 has a high-pressure portion 12 and an intermediate-pressure portion 13. Rotor blades 14 are arranged in the high-pressure portion 12. Rotor blades 15 are likewise arranged in the intermediate-pressure portion 13.

Live steam at temperatures of over 550° C. and a pressure of over 250 bar flows into an inflow region 16. The live steam flows through the individual guide vanes 8 and rotor blades 14 in the high-pressure part 12 and is in the process expanded and cooled. At least in this region, the inner casing 5 and the turbine shaft 3 should be designed for temperatures of over 550° C. In the process, the thermal energy of the live steam is converted into rotational energy of the turbine shaft 3. As a result, the turbine shaft 3 is made to rotate in a direction illustrated around the axis of rotation 4.

After it has flowed through the high-pressure part, the steam flows out of an outflow region 17 into a reheater (not shown in more detail), where it is brought to a higher temperature and a higher pressure. This heated steam then flows via lines that are not shown in more detail into an intermediate-pressure inflow region 18 into the compact steam turbine 1. The steam which has been heated in the reheater flows past the rotor blades 15 and guide vanes 9 and is thereby expanded and cooled. The conversion of the energy intrinsic to the reheated steam into kinetic energy causes the turbine shaft 3 to rotate. The expanded steam which flows out of the intermediate-pressure part 7 flows out of the compact steam turbine 1 from an outflow region 19. This expanded steam flowing out can be used in low-pressure partial turbines, which are not illustrated in more detail.

The turbine shaft 3 is mounted in a bearing region 23 comprising the outer casing 5. The rotor blades 14, 15 are not shown in more detail. The live steam first of all passes onto the middle region 16 of the turbine shaft 3 and is expanded in the high-pressure part 6. The live steam is cooled in the process. After the reheater, the steam which has been expanded from the high-pressure part flows back into the middle region 16 at a high temperature. The reheated steam first of all flows onto the turbine shaft 3 at the location of the intermediate-pressure inflow region 18 and is expanded and cooled in the direction of the intermediate-pressure part 7. The steam which has been expanded and cooled in the intermediate-pressure part 7 then flows out of the compact partial turbine 1. The turbine shaft 3 comprises a material with a high hot strength. The material with a high hot strength is a chromium steel containing 9 to 12% by weight of chromium. The inner casing 5 is produced from a different material. In particular, the inner casing 5 is produced from a material with a lower hot strength than the material used to produce the turbine shaft 3.

The inner casing is in particular produced from a chromium steel containing 1 to 2% by weight chromium.

Different materials can be used for the turbine shaft 3 and for the inner casing 5 in high-pressure partial turbines, in intermediate-pressure partial turbines, combined high-pressure and intermediate-pressure partial turbines or combined intermediate-pressure and low-pressure partial turbines, pumps, compressors or gas turbines.

The invention claimed is:

1. A turbomachine, comprising:

a rotatably mounted turbine shaft made from a chromium steel material containing 9% to 12% by weight chromium;

an inner casing coaxial with the rotor shaft made from a chromium steel containing 1% to 2% by weight chromium and having a lower hot strength than the turbine shaft material.

2. The turbomachine as claimed in claim 1, wherein the inner casing and the turbine shaft have regions which are configured for use at temperatures of over 550° C.

3. The turbomachine as claimed in claim 2, wherein the turbomachine is a steam turbine.

4. The turbomachine as claimed in claim 3, wherein the steam turbine is a high-pressure partial turbine.

5. The turbomachine as claimed in claim 3, wherein the steam turbine is an intermediate-pressure partial turbine.

6. The turbomachine as claimed in claim 3, wherein the steam turbine is a combined high-pressure and intermediate-pressure partial turbine.

7. The turbomachine as claimed in claim 3, wherein the steam turbine is a combined intermediate-pressure and low-pressure partial turbine.

8. The turbomachine as claimed in claim 2, wherein the rotor material and the inner casing material have different coefficients of thermal expansion.

9. The turbomachine as claimed in claim 2, wherein the rotor material and the inner casing material have different rates of thermal expansion.

* * * * *